United States Patent [19]

Rohner et al.

[11] Patent Number: 4,729,216

[45] Date of Patent: Mar. 8, 1988

[54] SERVICE DEVICE AND METHOD FOR APPLYING AN AIR BLAST TO A BROKEN YARN END IN A RING SPINNING MACHINE

[75] Inventors: Joachim Rohner, Ebersbach/Fils; Helmut Nickolay, Goppingen, both of Fed. Rep. of Germany

[73] Assignee: Zinser Textilmaschinen GmbH, Fed. Rep. of Germany

[21] Appl. No.: 2,030

[22] Filed: Jan. 12, 1987

[30] Foreign Application Priority Data

Jan. 15, 1986 [DE] Fed. Rep. of Germany ..... 3600916

[51] Int. Cl.[4] ..... D01H 15/00; D01H 13/00; B65H 54/22; B65H 54/88

[52] U.S. Cl. ..... 57/305; 57/261; 57/278; 57/279; 57/304; 242/35.6 E

[58] Field of Search ..... 57/261, 279, 304, 305, 57/278, 280; 242/35.6 E, 35.6 R, 36, 37 R

[56] References Cited

U.S. PATENT DOCUMENTS

| | | | |
|---|---|---|---|
| 3,236,464 | 2/1966 | Wey | 242/35.6 E X |
| 3,637,148 | 1/1972 | Kupper | 242/35.6 E |
| 3,807,155 | 4/1974 | Miyazaki et al. | 57/305 X |
| 3,813,865 | 6/1974 | Hohloch | 57/305 |
| 3,868,813 | 3/1975 | Vignon | 57/305 |
| 4,132,057 | 1/1979 | Weiss et al. | 57/261 |
| 4,565,062 | 1/1986 | Nickolay | 57/279 X |
| 4,570,433 | 2/1986 | Nickolay | 57/305 |

FOREIGN PATENT DOCUMENTS

| | | |
|---|---|---|
| 2423493 | 11/1975 | Fed. Rep. of Germany . |
| 2543767 | 4/1977 | Fed. Rep. of Germany . |
| 3316108 | 11/1984 | Fed. Rep. of Germany . |

*Primary Examiner*—John Petrakes

*Attorney, Agent, or Firm*—Shefte, Pinckney & Sawyer

[57] ABSTRACT

A service device in a ring spinning machine is moved after a yarn break to the appropriate spinning position to separate the broken yarn end from the winding by generating an air blast that acts on the yarn end. If the winding build-up is in a stage in which the initial winding cone has not yet been completed, the air blast is set at a high value so that a relatively strong separating force acts on the broken yarn end. If, on the other hand, the build-up of the winding cone has been completed, the separating force acting on the yarn end is less. The stage of the winding build-up is determined with the aid of a switch, which is connected to a stop member that contacts and rests on the ring rail of the spinning position. The setting of the two air blasts is performed by a switchable trottle. Taking into consideration the stage of the winding build-up when setting the air blast that acts on the yarn end assures that the broken yarn end is separated in every instance from the winding, yet prevents loops from being separated at the same time.

17 Claims, 5 Drawing Figures

SERVICE DEVICE AND METHOD FOR APPLYING AN AIR BLAST TO A BROKEN YARN END IN A RING SPINNING MACHINE

BACKGROUND OF THE INVENTION

The present invention relates to a service device and method for applying an air blast to a broken yarn end in a ring spinning machine with a force for separating the yarn end from the previously wound yarn windings at the spinning position, and more particularly to such a service device and method in which the separating force is automatically set in relation to the extent of the build-up of previously wound windings at the spinning position.

Service devices for ring spinning machines are known for providing a blow-off device for separating a broken yarn end from the windings at a spinning position of the ring spinning machine. Such devices move along the spinning machine and automatically stop at spinning positions at which a yarn has broken and guide a blow-off nozzle in relation to the ring rail of the spinning position for directing an air blast onto the windings that separates the broken end from the windings with the aid of a compressed air source connected to the nozzle. The separated yarn end is taken up, for example, by a suction bell and processed further by the service device.

It was found that during the operation of the known service devices, the air blast is difficult to dose and the broken yarn end is not always separated from the winding in the manner desired. If the air blast is too strong, loops can be separated form the windings with the yarn end and, if the air current is too weak, no separation of the yarn end from the winding may occur.

SUMMARY OF THE INVENTION

The present invention provides a service device and method that function to produce reliable separation of a broken yarn end from the winding of a spinning position without loops being separated.

Briefly described, the present invention provides a service device for use in a ring spinning machine for traveling to individual spinning positions to apply an air blast to a broken yarn end to separate it from the previously wound yarn windings at the spinning position. Means are provided for detecting the extent of the winding build-up at the spinning position and means are also provided for setting the separating force applied by the air blast on the yarn, with the detecting means acting automatically on the setting means to cause the setting means to set a lesser separating force upon detection of a greater extent of winding build-up. The method of the present invention involves detecting the extent of the winding build-up at the spinning position and automatically setting the separating force of the air blast that acts on the yarn in response to the detecting to apply a lesser force in response to detection of a greater extent of winding build-up.

With the aid of this invention, the extent of the winding build-up on a tube at a winding position is recognized and the separating force which acts on the yarn end in order to separate it is set as a function thereof. This is based on the recognition that in order to reliably separate a yarn end from windings of the build-up of the initial winding cone, a greater separating force is necessary than is necessary to separate a yarn end from windings beyond the build-up of the initial winding cone.

The invention makes possible a dosing of the separating force acting on the yarn end as a function of the particular stage of the winding so that on the one hand the separation of the thread end from the winding is assured and on the other hand the separation of loops is avoided. Without the present invention, an air blast of sufficient force for separating a yarn end from a build-up of winding that is beyond the initial cone of windings may not be of sufficient force to separate a yarn end from initial cone windings, and conversely an air blast sufficient to separate a yarn end from initial cone windings may cause undesired separation of loops of yarn with the yarn end if applied to windings that have been wound beyond the initial cone of windings.

In a first embodiment of the invention, the separating force acting on the yarn end for separation is set in such a manner that a lesser force acts at a more advanced winding build-up. Thus, as the winding increases, the separating force that will be applied on the yarn end decreases.

In a second embodiment of the invention, the separating force acting on the broken yarn end is set in such a manner that after the build-up of the initial winding cone, at least approximately the same separating force is set for a winding build-up of any extent more than the initial cone of windings. During the build-up of the winding cone, the separating force setting decreases as the winding progresses. This takes into consideration the fact that after the build-up of the winding cone, the angle of this cone changes only unessentially and the separating force necessary for the separation of a broken yarn end likewise varies only slightly therewith throughout the remainder of the winding.

In a third embodiment, the separating force acting on the yarn end for separation is set to at least approximately the same value upon detection of any extent of winding build-up, less than completion of the build-up of the initial winding cone, and is set to a lesser value upon detection of more windings than the initial cone, with the value being at least approximately the same for all such detections of more windings. By means of this, the build-up of the winding of the tube is subdivided into two areas, namely, into one before and one after completion of the initial winding cone. Then, a greater separating force acts on the yarn end to be separated before completion of the winding cone and a lesser force acts on it after completion, as a function of the state of the winding. As will be explained below, this makes possible a simple technical utilization of the invention.

Preferably, the detecting means includes a contact element that is movable into contact with the ring rail of the ring spinning machine to detect the extent of the winding build-up. A switch or potentiometer is responsive to the position of the contact element and is included in the setting means in determining the separating force to be applied. Thus, the extent of winding build-up is derived by this arrangement from the position of the ring rail upon contact by the contact element with its connection to the potentiometer or switch. For example, it is possible to detect the lowest position of the ring rail reciprocation at the time of yarn break and to detect thereby the stage of the winding.

It is advantageous, in order to detect the extent of the winding build-up, to provide a potentiometer or a switch or both in the service device. A guided element of the service device which can be coupled to the ring rail of the ring spinning machine acts on the potentiometer or the switch. This extent of the winding build-up is derived therewith from the position of the ring rail after coupling of the element to the potentiometer or the switch. For example, it is possible to always detect the lowest position of the ring rail reciprocation and to deduce the stage of the winding from this position.

In order to accurately detect the stage of the winding build-up, at least one potentiometer may be used and the potentiometer or potentiometers may be responsive to the contact element over the entire length of the tube or only over the extent of the initial winding cone. In a simplified form, only one switch is necessary and it is switched over after completion of the initial winding cone.

It is also possible to detect the extent of the winding with the aid of a timing circuit. This embodiment is based on the recognition that the build-up of the winding on the tube is determined in terms of time related to the operating speed of the ring spinning machine. Thus, if the start point in time of a winding is known, the extent of the winding build-up can be deduced from the elapsed winding time. The winding time is measured by the timing circuit, whereby the start of the winding process is imparted to the timing circuit by the ring spinning machine. In order to set the separating force which acts on the yarn end by the air blast, it is advantageous to provide a throttle, which may be adjustable, and which can be responsive to the position of the contact element to throttle the supply air from a compressed air source to a nozzle which blows out the air blast. It is also possible to use a nozzle with an adjustable section which blows out the air blast or use a compressed air source that provides an adjustable work pressure.

A switching between two given separating forces is achieved as follows, for example: A parallel circuit is provided in the supply line from the pressure-generating device to the blow-off nozzle in the two branches of which a throttle and a switchable valve are located. If a greater force is required during the build-up of the winding cone for separating a broken yarn end, the switchable valve is opened and the air blast which can be generated by the pressure-generating device acts on the yarn end. If, on the other hand, the winding cone has been completed and a lesser force is therefore required to separate a broken yarn end, then the switchable valve is closed, which causes the air blast now acting on the yarn end to be determined by the switched-on throttle. It is advantageous if the throttle and/or the work pressure of the compressed air source can be manually adjusted.

A control device is preferably provided in the service device as a connection between the means for detecting the extent of the winding build-up and the means for setting the force which acts on the yarn end by the air blast. It is advantageous, particularly when using continuously adjustable throttles or the like and/or when detecting the extent of the winding build-up by a timing circuit to use a programmable computer as the control device.

Other features and advantages of the invention will be apparent from the following description of the preferred embodiments of the invention which are shown in the drawings.

DETAILED DESCRIPTION OF THE PREFERRED EMBODIMENTS

Figure 1:
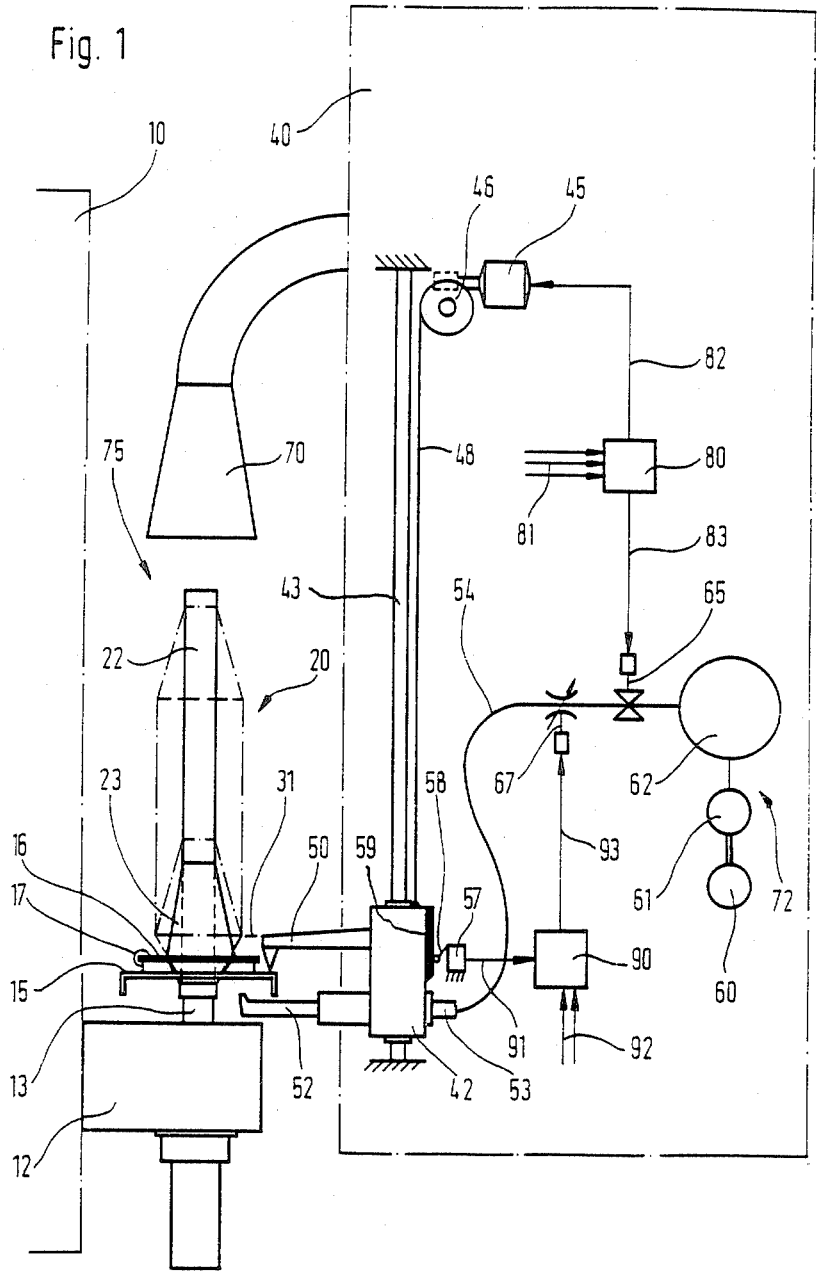
FIG. 1 is a schematic illustration of a service device incorporating a preferred embodiment of the present invention and including in the illustration basic associated components of a spinning position that are used for the production of a cop of wound yarn.

In the embodiment of FIG. 1, a vertically positioned spindle 13 at a spinning position 75 of a ring spinning machine 10 is mounted on a spindle bearing plate 12. The spindle 13 rotates in a ring rail 15, which is driven upwardly with a superimposed vertically reciprocating motion to build a cop of wound yarn. A ring 16, on which a traveler 17 revolves in a known manner, is positioned on the ring rail 15 coaxially with spindle 13. A tube 22 is set on the spindle 13, for forming a cop 20 of wound yarn shown in dotted lines.

While the spun yarn is being wound onto the tube 22, the ring rail 15 with the rotating traveler 17 guides the yarn slowly upward. A more rapid vertical reciprocation of the ring rail 15 is superimposed on this upward movement. This causes the individual yarn windings to lie next to each other and form a winding layer. At the start of the winding process, the winding layers run approximately parallel to tube 22. Particularly, as a result of the influence of the ring rail reciprocation, the individual winding layers form an angle with the tube 22 after a certain winding time which is acute at first and becomes more obtuse as the winding time increases. In the section of cop 20 of FIG. 1 shown in FIG. 2, these angles are designated by the reference numerals 24 and 24', with windings having these angles designated by reference numerals 23,23' and the outer winding layers of these windings by reference numerals 25,25'.

Figure 2:
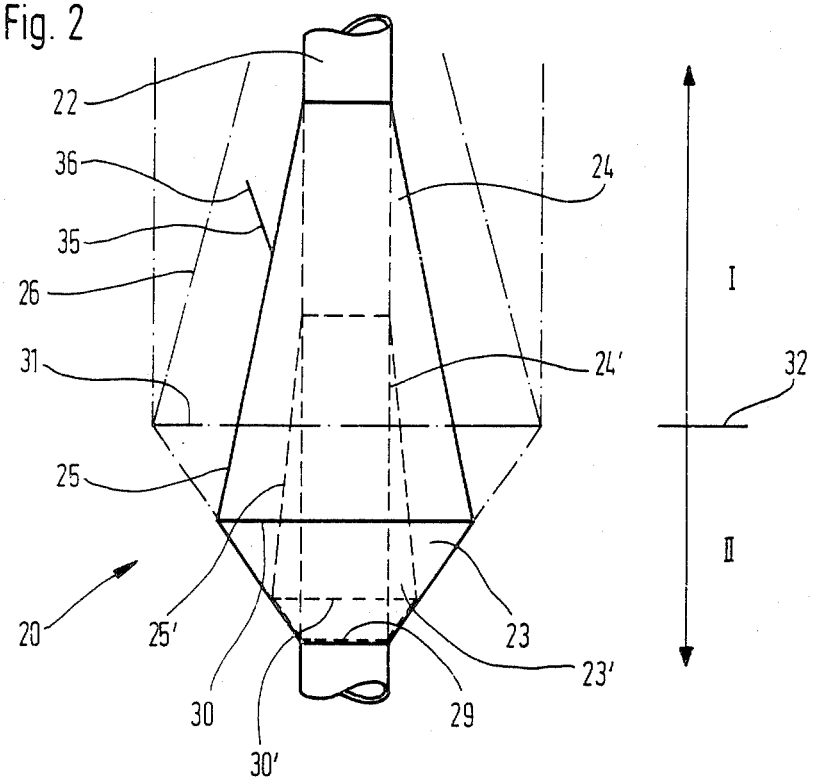
FIG. 2 is an elevational view of a partially wound cop of FIG. 1.

In the cop 20 shown in FIG. 2, the winding 23' is produced first in time and then the winding 23. As a result of angles 24' and 24 becoming more obtuse, the winding layers 25',25 form cones which become more and more obtuse. Once these cones reach a certain form, which is in the form of an initial winding cone, designated in FIG. 2 as the winding cone 26, the ring rail reciprocation is set at a certain extent that is continued throughout further winding. This causes all winding layers of the subsequent winding process to run with an inclination which corresponds to the angle of the completed initial winding cone 26.

The first winding of the spun yarn on tube 22 is designated in FIG. 2 by reference numeral 29 and is determined by the setting of ring rail 15 at the start of the winding process. As the winding 23' is wound on tube 22, a determination of this first winding is made by the lowest position 30' of the ring rail reciprocation at this time. In an analogous manner, the winding 23 is associated with the position 30, which is defined by the lowest position of the ring rail play at this time. Once the cones formed by the winding layers 25',25 reach the form of the completed winding cone 26, the lowest position of the ring rail 15 reciprocation corresponds to the position 31.

The area in which the ring rail 15 moves after the build-up of the initial winding cone 26 is shown in FIG. 2 as Area I and the area lying thereunder is designated as Area II. The border between Areas I and II is designated by the reference numeral 32.

Finally, FIG. 2 shows a broken yarn 35 belonging to winding 23, by way of example, the yarn end of which is designated by reference numeral 36.

In FIG. 1, a carriage 42 is movably positioned on a vertical track 43 of the service device 40 and is held by a wire cable 48. A motor 45 drives a drum 46, onto which and off which the wire cable 48 can be wound.

In order to repair a yarn break, the carriage 42 is lowered, after the service device 40 has been moved to the appropriate spinning position 75, until a contact or stop member 50 attached to the carriage 42 contacts and rests on the ring rail 15. As a consequence of this contact, the carriage 42 participates in all movements of ring rail 15, in particular the ring rail reciprocation.

A nozzle 52 is attached to the carriage 42 and extends under the ring rail 15 after the stop member 50 has come to rest on the ring rail 15. The nozzle 52 is connected by a connection piece 53 and a supply line 54 to a source 72 of compressed air, which consists essentially in a known manner of a motor 60, a pump 61 and an air reservoir 62. An electromagnetically switchable valve 65 and an electromagnetically adjustable throttle 67 are located in the supply line 54.

An electrochemical switch 57 is permanently attached in the service device 40, from which switch a switching arm 58 projects. A switching cam 59 is mounted on the carriage 42 in such manner that it moves against the switching arm 58 when the carriage 42 is lowered below a certain position, wherewith it actuates the switch 57. The switching cam 59 and/or the switch 57 and its switching arm 58 can be set manually in such a manner in relation to each other before the service device 40 is put in operation that the switching threshold of the switch 57 corresponds approximately to the aforementioned position 31 or limit 32. This causes the switch 57 to be actuated if the extent of winding build-up at the time the service device 40 is put in operation is in the area of the initial winding cone 26.

A switching device 80 is connected by electrical lead lines 82,83 to a motor 45 and a valve 65, and is connected by other electrical lead lines 81 to other components of the service device 40 and/or the ring spinning machine 10. This switching device 80 controls the motor 45 and valve 65 as a function of the signals with which the switching device 80 is loaded by the lines 81. In particular, the switching device 80 brings about the lowering of the carriage 42 after the service device 40 has been appropriately positioned at the spinning position 75, and controls the valve 65, which is in the aforementioned compressed air supply line 54, after the carriage 42 has been lowered.

The control device 90 is connected by electrical lead lines 91,93 to the switch 57 and the throttle 67. Moreover, other components of the service device 40 and/or of the ring spinning machine 10 are connected to the control device 90 by electrical lead lines 92. Thus, the control device 90 controls the throttle 67 as a function of at least the signal which the control device 90 receives from the switch 56 through the line 91.

If the service device 40 has been moved to a spinning position 75 where a yarn break has occurred, and, if the carriage 42 has been moved into contact with the ring rail 15 through the stop member 50 and the nozzle 52 moved under ring rail 15, then the switching device 80 opens the valve 65 so that air flows out of the nozzle 52 and acts on the winding 23 lying thereover.

If the winding 23 is in a stage in which the initial winding cone 26 has not yet been completed (Area II), then the ring rail 15 is reciprocating with a lowermost position below the position 31, which condition is communicated to the control device 90 by the actuation of the switch 57. A single switching of the switch 57 releases a self-holding contact in the control device 90, which contact opens the throttle 67 for a preset length of time to produce an air blast on the yarn end 36 that provides a separating force to separate the yarn end 36 from the winding 23. As a consequence of the air blast, which temporarily blows out of the nozzle 52, the separated yarn end 36 is blown upward to a suction bell 70, which is connected with a vacuum source to grasp the yarn into the suction bell 70 and manipulate it, as by oscillating or otherwise moving the spinning rolls to piece the yarn end 36 to the roving for resumption of spinning. With this arrangement the throttle will be fully open at any spinning position at which less than a complete initial cone has been wound before a yarn break, and, therefore, at least approximately the same separating force will be applied by the air blast where the contact element 50 has detected the windings are of any extent less than the build-up of a complete initial winding cone.

If, on the other hand, the winding 23 is in a stage in which the initial winding cone 26 has been completed (Area I) and the ring rail 15, therefore, is no longer moving below the position 31, then the switch 57 is not actuated by the ring rail reciprocation and the throttle 67 is set by the control device 90 to a stage, as a result of the non-actuating of the switch 57, which applies a lesser separation force of the air blast from the nozzle 52, but which is nevertheless sufficient, due to the lesser resistance of the formed windings to separate the yarn end 36 from the winding 23. With this arrangement the throttle will be partially open at any spinning position at which more than a complete initial winding cone has been wound before a yarn break, and, therefore, at least approximately the same separating force will be applied by the air blast where the contact element 50 has detected the windings are of any extent more than the build-up of a complete initial winding cone.

In both instances the throttle 67 is set just so that on the one hand the broken yarn end is reliably separated from the winding 23 and on the other hand a separating of loops is avoided. These settings can also be changed during the operation of the service device 40 by the control device 90 as a function of other magnitudes characterizing the operating stage of the service device 40 and/or the ring spinning machine 10.

Figure 3:
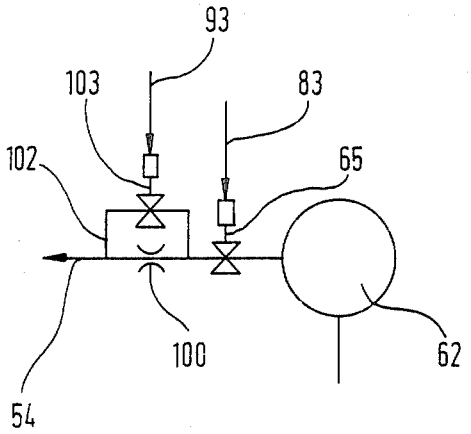
FIG. 3 is a schematic illustration of a throttle that can be incorporated in the service device of FIG. 1.

In FIG. 3 a parallel circuit is interconnected into the supply line 54 from the air reservoir 62 to the nozzle 52 in one branch of which a throttle 100 is located and in the other branch of which, designated by reference numeral 102, an electromagnetically actuatable valve 103 is located. The throttle 100 can be set manually, while the valve 103 can be switched as a function of the signal on line 93 responsive to the detection ofthe winding stage by the contact element 50.

If the switch 57 is not actuated by the reciprocation of the ring rail, then the yarn has been wound to the build-up area of Area I and valve 103 is closed by the control device 90. This limits the air blast flowing out of the nozzle 52 to a magnitude which is determined by the throttle 100. If, on the other hand, the winding build-up is located in Area II, then valve 103 is opened and the broken yarn end 36 is subjected to the maximum air blast which the air reservoir 62 can generate.

The embodiment of FIG. 3 provides two air blast conditions, while the adjustable throttle 67 of the embodiment of FIG. 1 provides a gradually varying separating force by the air blast.

Figure 4:
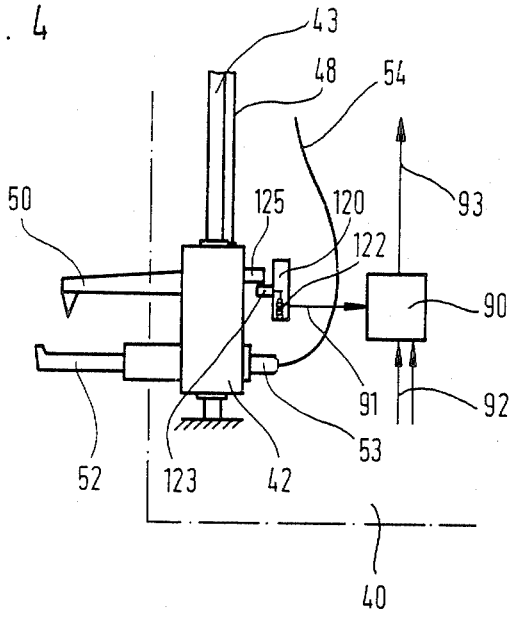
FIG. 4 is a schematic illustration of a potentiometer that can be incorporated in the service device of FIG. 1.

In FIG. 4, a potentiometer 120 is mounted on the service device 40, and a pin 125 projects from the carriage 42 for contacting and moving a central lever 123 of the potentiometer 120. The potentiometer 120 is provided with a spring 122 which presses the central lever 123 against the pin 125.

In comparison of the embodiments of FIGS. 1 and 3, in which only the Areas I and II can be distinguished with the aid of switch 57, it is possible in the embodiment of FIG. 4 to detect the particular extent of the build-up of winding 23 on tube 22. If the embodiment of FIG. 4 is combined with a continuously adjustable throttle 67 according to FIG. 1, it is then possible to set the separating force applied by the air blast on broken yarn end 36 as a function of the extent of the winding build-up. Thus, the separating force acting on the yarn end 36 can be adapted to any stage of the winding build-up.

If the potentiometer 120 extends over the entire length of the tube 22, then the air blast acting on the yarn end 36 can also be set in response to the extent of the winding build-up over the entire winding build-up. If, on the other hand, the potentiometer 120 extends only approximately to a height which corresponds to the level 31, then responsive adjustment of the air blast acting on the broken yarn end 36 is possible only in the area of the build-up of the initial winding cone 26. Thereafter, the pin 125 lifts off the central lever 123 and the potentiometer 120 remains at the same setting for windings in Area I.

Figure 5:
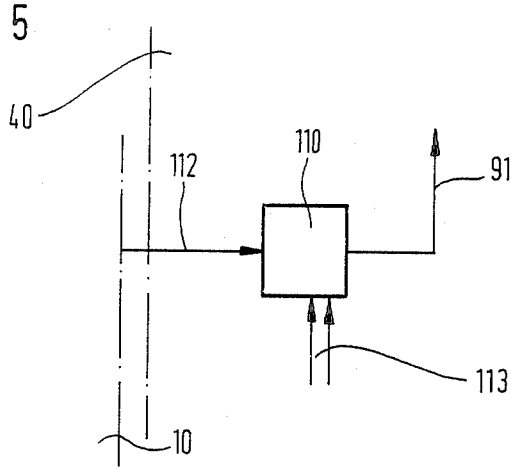
FIG. 5 is a block diagram of a timing circuit that can be used to control the service device of FIG. 1.

In FIG. 5, a timing circuit 110 is connected by an electrical lead line 112 to the ring spinning machine 10 and by an electrical lead line 91 to the control device 90. Moreover, other components of the service device 40 and/or of ring spinning machine 10 can be connected to the timing circuit 110 by line 113.

The timing circuit 110 is a continuous meter in its simplest form which can be set back by an actuating signal. This actuating signal is fed to the timing circuit 110 by an electrical lead line 112 when the ring spinning machine 10 begins winding of spun yarn 35 on the tube 22. This actuating signal from the ring spinning machine 10 to the service device 40 can be transmitted optically, electromagnetically or in any other manner. As a result, a numerical value is available to the control device 90 at every instant corresponding to the time elapsed since the start of the winding process. On the basis of the known work speed of the ring spinning machine and, optionally, with the aid of other parameters of the service device 40 and of the ring spinning machine 10, the control device 90 can deduce the extent of the build-up of winding 23 on tube 22 from this numerical value. Then the separating force of the air blast acting on the broken yarn end 36 to separate it can be set in a two-stage manner or continuously by the control device as a function thereof.

The embodiment shown in FIG. 5 creates the possibility of replacing the switch 57 or potentiometer 120 by a time function. The functions of timing circuit 110 and of control device 90 can be combined especially by using a programmable computer in the service device 40.

Another possibility of simplifying the previously described embodiments is to design the compressed air source 72 in such a manner for a gradual adjustment of the separating force of the air blast exiting from the nozzle 52 over the full extent of winding with the work pressure being set by the control device 90. It is also possible to design the nozzle 52 in such a manner that it has an adjustable nozzle section for adjusting the separating force applied by the nozzle. In addition, it is possible to set the separating force of the air blast exiting from the nozzle 52 so that the radial and/or axial distance of the nozzle 52 to the winding on the cop 20 is set in correspondence with the greater or lesser separating force required, that is, how far the nozzle 52 is extended. It is likewise possible to vary the separating force by putting an adjustable barrier to the air blast, e.g. a wire grid, at the exit end of the nozzle 52.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A service device for a ring spinning machine for traveling to individual spinning positions to apply an air blast to a broken yarn end to separate it from the previously wound yarn windings at the spinning position, said service device comprising means for detecting the extent of the winding build-up at the spinning position, means to apply an air blast, and means for setting the separating force applied by said air blast on the yarn, said detecting means acting automatically on the setting means to cause said setting means to set a lesser separating force upon detection of a greater extent of winding build-up.

2. A service device according to claim 1, characterized further in that said setting means is responsive to said detecting means to set a lesser separating force upon detection by said detecting means of a greater extent of winding build-up during build-up of an initial cone of windings and to set a constant separating force in response to detection by said detecting means of any extent of winding build-up more than the build-up of an initial cone of windings.

3. A service device according to claim 2, characterized further in that said setting means is responsive to said detecting means to set a separating force of a constant set force or greater upon detection by said detecting means of any extent of winding build-up less than completion of the build-up of the initial winding cone, with said constant separating force upon detecting more windings than the initial cone being less than said constant or greater operating force upon detecting less windings than completion of the initial cone.

4. A service device according to claim 1 wherein the ring spinning machine has a reciprocating ring rail, said service device being characterized further in that said detecting means includes a contact element movable into contact with said ring rail to detect the extent of the winding build-up.

5. A service device according to claim 4, characterized further in that said setting means includes a switch responsive to the position to which said contact element has moved.

6. A service device according to claim 4, characterized further in that said setting means includes a potentiometer responsive to the position to which said contact element has moved.

7. A service device according to claim 1, characterized further in that said detecting means includes a timing circuit responsive to the elapsed time of winding of said previously wound yarn winding to provide a detection of the winding build-up.

8. A service device according to claim 1, wherein the service device includes a source of compressed air, an air nozzle for applying said air blast, and a supply line connecting said source and said nozzle, said service device characterized further in that said setting means includes a throttle in said supply line for setting said separating force.

9. A service device according to claim 8, characterized further in that said throttle is adjustable.

10. A service device according to claim 8, characterized further in that said throttle is switchable.

11. A service device according to claim 8, characterized further in that said detecting means includes a contact element movable into contact with said ring rail to detect the extent of the winding build-up, and said throttle is responsive to the position to which said contact element has moved.

12. A service device according to claim 1, characterized further by a nozzle through which the air blast is applied, and in that said setting means includes an adjustable nozzle section for setting the separating force.

13. A service device according to claim 1, wherein the service device includes a source of compressed air, said service device characterized further in that said setting means includes means for adjusting the work pressure of compressed air from said source for setting the separating force.

14. A service device according to claim 1, characterized further by a control device connected to the detecting means and to the setting means.

15. A method for separating a broken yarn end from previously wound yarn windings at a spinning position of a ring spinning machine by means of an air blast which acts on the yarn end with a separating force, in which a service device which generates the air blast is moved to the spinning position, said method comprising detecting the extent of the winding build-up at the spinning position, applying an air blast, and automatically setting the separating force of the air blast that acts on the yarn end in response to said detecting to apply a lesser force in response to detecting of a greater extent of winding build-up.

16. A method according to claim 15, characterized further by setting at least approximately the same separating force upon detection of any extent of winding build-up more than the build-up of an initial cone of windings.

17. A method according to claim 16, characterized further by setting at least approximately the same separating force upon detection of any extent of winding build-up less than completion of build-up of the initial winding cone, with said same separating force upon detecting more windings than the initial winding cone being less than said same operating force upon detecting less windings than completion of the initial cone.

* * * * *